United States Patent [19]

Lemmer et al.

[11] Patent Number: 4,713,636

[45] Date of Patent: Dec. 15, 1987

[54] CIRCUIT-BREAKER

[75] Inventors: Helmut Lemmer, Marienheide-Kalsbach; Josef Risthaus, Gummersbach, both of Fed. Rep. of Germany

[73] Assignee: Square D Starkstrom GmbH, Fed. Rep. of Germany

[21] Appl. No.: 888,422

[22] Filed: Jul. 23, 1986

[30] Foreign Application Priority Data

Mar. 21, 1986 [EP] European Pat. Off. ..... 86103894.1

[51] Int. Cl.[4] ..... H01H 77/00; H01H 83/00; H01H 81/00

[52] U.S. Cl. ..... 335/35; 335/22; 335/172

[58] Field of Search ..... 335/9, 10, 21, 22, 35, 335/172, 173, 175, 23, 38, 39, 132

[56] References Cited

U.S. PATENT DOCUMENTS 4,124,833 11/1978 Stoger ..... 335/173

4,631,507 12/1986 Guery et al. ..... 335/173

*Primary Examiner*—E. A. Goldberg
*Assistant Examiner*—Lincoln Donovan
*Attorney, Agent, or Firm*—Diller, Ramik & Wight

[57] ABSTRACT

A circuit-breaker which includes a housing, an actuator device positioned in generally upstanding relationship to and centrally of the housing, thermal trippers and magnetic trippers mounted on one side of the actuator device, an electromagnetic drive including an armature for operating an associated element, the electromagnetic drive being mounted on a side of the actuator device opposite the thermal and magnetic trippers, a pair of pivotally connecting links, the links being operated by a pivoted yoke by energization of the armature, one of the links having a nose received in a slot of a slide, and the magnetic and thermal trippers also having noses received in slots of a slide such that selective turn-on and turn-off conditions can be achieved manually or automatically.

19 Claims, 9 Drawing Figures

FIG.1
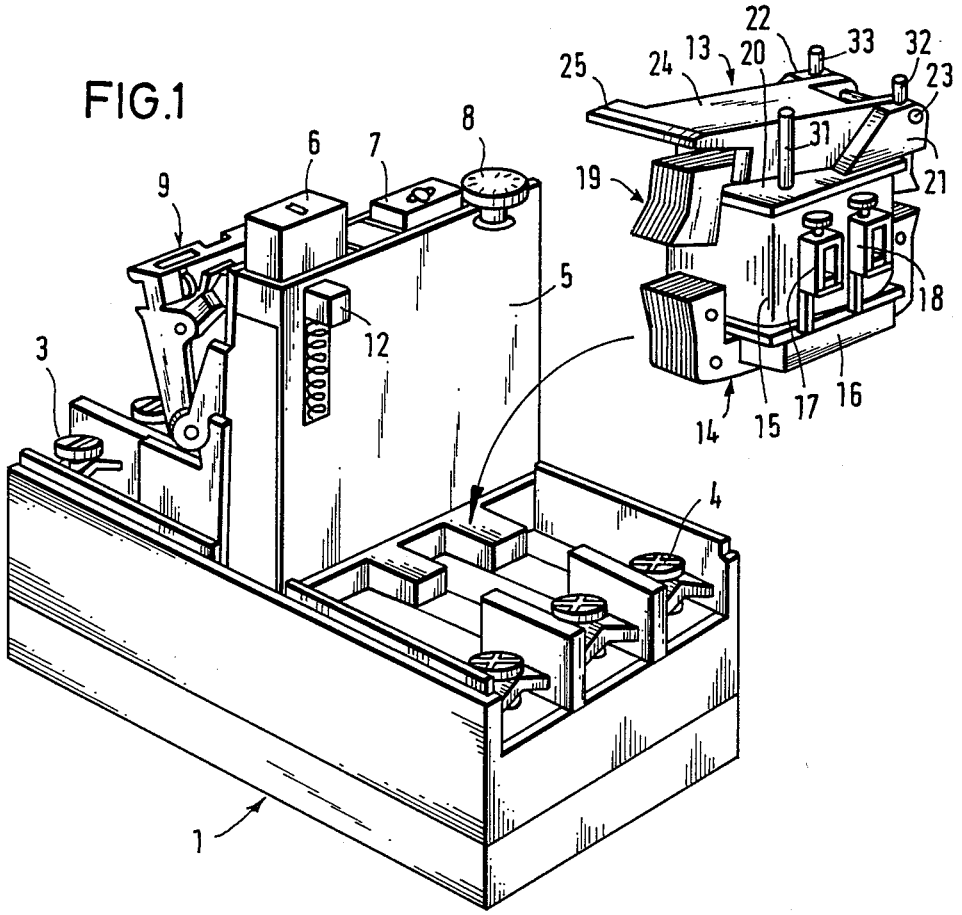
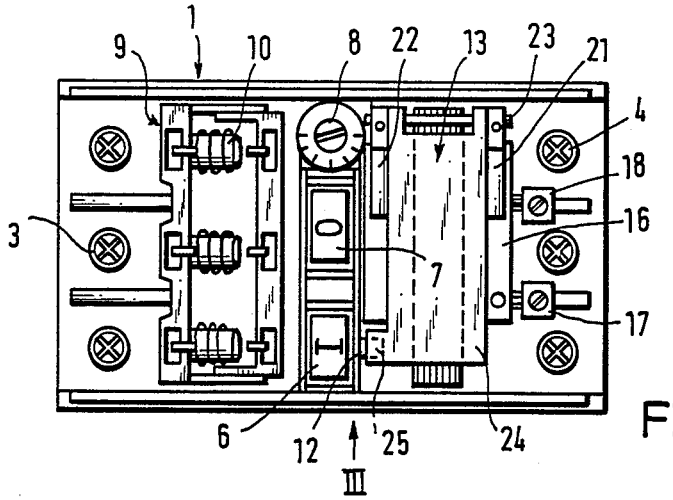
FIG.2

FIG.8
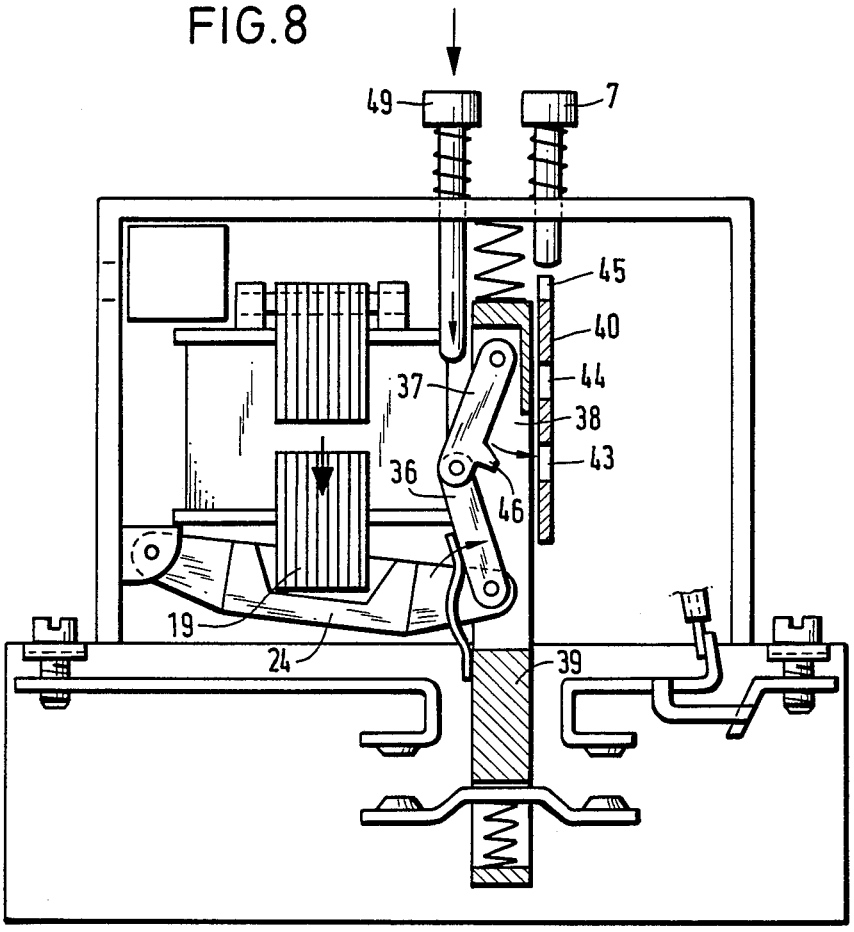
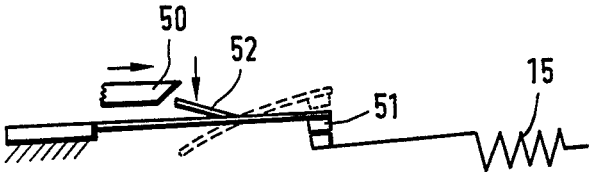
FIG.9

CIRCUIT-BREAKER

BACKGROUND OF THE INVENTION

The invention relates to circuit-breakers and/or motor protection switches. Ordinarily a motor protection switch includes a circuit-breaker having associated therewith a thermal device which protects the motor in a conventional fashion by cutting-out thermal trippers and thus opens the motor circuit. Normally such conventional circuit-breakers include a housing carrying a system of contacts which are controlled by thermal and magnetic trippers. The magnetic system is generally located either on the assembly side of the set of contacts of the housing or on the side opposite thereto, namely, above the set of contacts which are at the bottom of the housing, i.e., the assembly side. A movable armature of the magnetic system is connected by a conventional coupling to a contact-bridge holder of the set of contacts.

In this conventional design the magnetic system together with the surrounding housing is relatively bulky and highly complex making assembly thereof quite difficult. Moreover, the thermal trippers only trip when the current drain, i.e., the thermal load, exceeds a given value, and irrespective of the relatively high complexity of the design of the latter, such thermal trippers are comparatively inert because the current drain or the thermal load increases only slowly, at least most of the time. Therefore, in order to assure that the motor is protected against sudden electrical malfunctions, such as shorts, a further separate circuit-breaking means is required in such conventional circuit-breakers. Heretofore, the latter has been provided by being mounted in a housing separate from the first-mentioned circuit breaker housing, and in order to connect the electrical components of these two housings, a total of eighteen electrical connections must be made.

It is furthermore noted that in order to connect an ordinary circuit-breaker consisting of a set of contacts and a magnetic protection system by means of electrical conductors to a separate motor protection switch, the total number of electrical connections is twelve.

Both of the latter designs entail complex and time-consuming wiring and a substantial expenditure of material is required both for the many conductors and for the many connections between the conductors of the various electrical components of the housing(s). Therefore, there is not only an inordinate expenditure during installation, but such multiple devices are bulky which is particularly disadvantageous when they are installed inside a conventional switch box.

SUMMARY OF THE INVENTION

In accordance with this invention, the circuit-breaker thereof is of relatively compact design requiring only a little space in an associated switch box and/or circuit-breaker and conventional wiring is eliminated or can be basically implemented internally of the circuit-breaker itself. Furthermore, the thermal device or thermal trippers for the three phases, the magnetic drive or magnetic trippers, and trippers for "shorts" all act upon a switch latch which in turn can rapidly open the set of contacts on the assembly side of the housing to, thus, turn off / open the motor circuit and/or the protection switch thereof. Furthermore a deficient voltage or load-current tripper can also be provided. In the case where the circuit-breaker acts as a motor protection switch the turn-on button and the turn-off button normally can only be actuated manually except for the automatic turn-off through the motor protection switch. However, since there is a substantial need for circuit-breakers which can be automatically turned on or off, the present circuit-breaker can not only be operated manually through conventional turn-on and turn-off buttons, but can be switched on and off remotely by hand or through the machinery being protected. Thus, the circuit-breaker can not only respond to manual actuation, but remotely to conditions adverse to an electric motor against which there must be protection, and this is done without significantly increasing the cost of manufacturing the circuit-breaker.

The advantages noted relative to the invention are realized by providing an electromagnetic drive whose armature operates a turn-on button, and the electromagnetic drive is mounted on one side of the actuation device whereas on the opposite side thereof is mounted the thermal and magnetic protecting devices or trippers. In this fashion, electrical connections to the electromagnetic drive can be made with ease and the electromagnetic drive can be rapidly assembled to and removed from the housing without in any fashion altering the relationship thereof to the thermal and magnetic trippers.

With the circuit-breaker constructed as just described, the electromagnetic drive is connected to the thermal and magnetic trippers through the actuation device or switch latch, and this is accomplished through an armature of the electromagnetic drive which is connected to a pair of links which move between two over-the-center positions, and a projection of one of the links is operatively connected to a slider for operating the thermal and magnetic trippers. An advantage of the latter construction is that the overall mass which is being moved when the circuit-breaker is being tripped is relatively small and, therefore, the tripping takes place very rapidly as the linkage/links move through dead center. Furthermore, the links or linkage also permit the conventional contact-bridges to be mounted on a common contact-bridge holder which can be moved rapidly to thereby particularly improve the short-circuit reliability of the circuit-breaker over conventional circuit-breakers.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view of a novel circuit-breaker constructed in accordance with this invention, and illustrates a housing, an upstanding actuation or actuator device, and an electromagnetic drive detached therefrom.

FIG. 2 is a top plan view of the circuit-breaker of FIG. 1, and illustrates the electromagnetic drive installed to one side of the actuator device and thermal and magnetic trippers at an opposite side thereof.

FIG. 8 is a longitudinal sectional view of the circuit-breaker of FIG. 5, and illustrates the position of the circuit-breaker elements prior to the actuation of an associated reset button.

FIG. 9 is a schematic view of an auxiliary device, and illustrates an accessory contact in a coil circuit of the armature of either of the circuit breakers of the invention.

DESCRIPTION OF THE PREFERRED EMBODIMENTS

Figure 3:
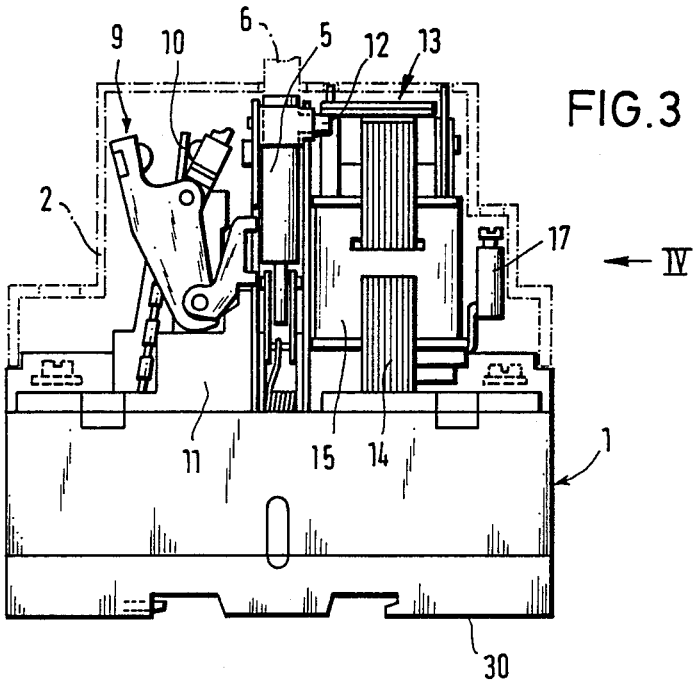
FIG. 3 is a side elevational view looking in the direction of the arrow III of FIG. 2, and illustrates with more specificity the relationship of the actuator device, the electromagnetic drive to one side thereof, and the thermal and magnetic trippers at an opposite side thereof.
Figure 4:
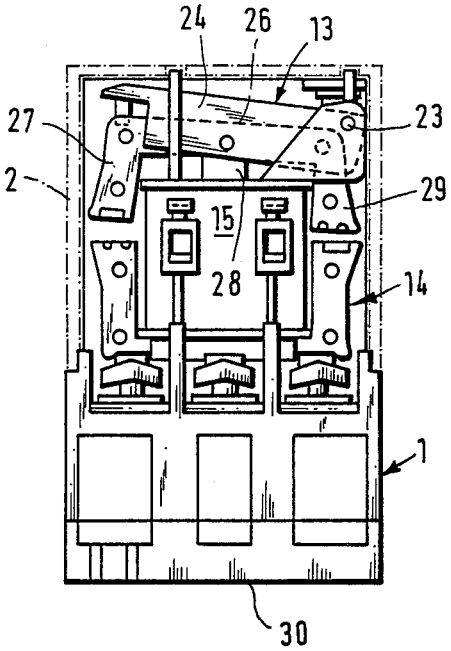
FIG. 4 is a front view of the circuit breaker looking in the direction of the arrow IV of FIG. 3, and illustrates a yoke of the electromagnetic drive which is operatively connected to the actuator device through a stud of the latter.

A novel circuit-breaker constructed in accordance with the first embodiment of this invention is shown in FIGS. 1 through 4 of the drawings and includes a housing having a lower housing portion or part 1 and upper housing portion, part or cover 2, the latter being illustrated by phantom lines in FIGS. 3 and 4. The lower housing portion 1 carries a set of conventional contacts which have been omitted from the drawings, but which are associated with conventional fixed contact rails, also not shown. received in the unnumbered grooves in the bottom of the lower housing portion 1 of FIG. 3. These fixed contact rails are electrically connected to three-phase power through conventional contact connection screws 3, 4 (FIGS. 1 and 2). The omitted set of contacts further includes a common contact-bridge holder, much like the common contact bridge 39 of FIG. 5 to be discussed hereinafter, with three contact-bridges inserted in a spring-loaded manner.

An actuation or actuator device in the form of a switch latch 5 is positioned in generally vertically upstanding relationship 2 and generally centrally of the housing and the lower housing portion 1 in particular, as is most readily apparent in FIGS. 1 through 3 of the drawings. The actuator device 5 is positioned above the set of contacts heretofore noted and generally perpendicular or normal to the planes of the drawings of FIGS. 2 and 3. The actuator device 5 carries a turn-on button 6 (FIGS. 1 through 3), a turn-off button 7, and a current adjusting dial 8.

The actuator device 5 includes internal mechanical mechanisms designed in such a manner that upon actuation of the turn-on button 6 the contact-bridge holder together with the contact bridges thereof can be made to assume the ON position with respect to the fixed contact rail (not shown). Likewise, when the turn-off button 7 is actuated, the turn-off procedure takes place correspondingly. Furthermore, thermal devices or trippers 9 cooperate with the actuator device 5 with each thermal tripper 9 including a bimetallic strip 10 mounted for every phase. Each thermal tripper 9 and its bimetallic strip 10 is mounted to one side of the actuator mechanism 5 which is the left-hand side in FIGS. 1, 2 and 3 of the drawings. Magnetic trippers and/or "short" trippers (not shown in FIGS. 1 through 4) are mounted one per phase and are operationally connected to the actuator device 5 much as in the case of the magnetic device or tripper 35 of FIG. 5, as will be described more fully hereinafter.

On the right-side of the actuator device 5, again as viewed in FIGS. 1, 2 and 3, and below the cover 2, there is seated an electromagnetic drive 13 which includes an armature 19 which acts on or in response to the turn-on button 6. The armature 19 has three legs 27, 28 and 29 (FIGS. 3 and 4).

The turn-on button 6 includes or carries a plastic stud 12 which projects laterally or sideways from the actuator device 5 through its wall (unnumbered). The stud 12 supports a projection 25 of a yoke 24 of the armature 19. As is shown in FIG. 1, the stud 12 includes a generally rectangular cross-section although the projection 25 may be advantageously formed of a triangular cross-section or angular cross-section whereby one horizontal leg (unnumbered) rests on the stud 12 (See FIG. 2) while the other leg passes around the front surface of the stud 12 (See FIG. 1).

A coil 15 of the electromagnetic drive 13 is mounted upon a center leg of the core 14. The coil 15 is equipped with a plastic base 16 to which are firmly fixed two coil terminals 17 and 18 by their connection screws (unnumbered). In this embodiment the armature 19 is preferably supported in a pivoting fashion, as is best illustrated in FIG. 4. For the latter purpose the armature 19 is enclosed in the area in associated cross-bar 26 (FIG. 4) thereof by the plastic generally U-shaped yoke 24. The yoke 24 is held between two lateral bearings or plates 21 and 22 (FIG. 2) near the right-hand end of the cross-bar 26 through a pivot pin 23. These two bearings or plates 21, 22 are in turn mounted upon an upper flange (unnumbered) of a bobbin 20 of the coil 15. In this design the projection 25 is an integral portion of the yoke 24 in the area of the other end of the cross-bar 26 remote from the pivot pin 23, again as it is best illustrated in FIGS. 1 and 2. Finally, the reference numeral 30 in FIGS. 3 and 4 indicates the upper assembly side of the circuit-breaker.

The coil 15 and the core 14 of the electromagnetic drive 13 are held in form-fitting manner within the space below the housing cover 2, and may be appropriately located thereat through guides, ribs, stops or the like. The armature 19 is free to pivot in the clear space provided within the housing cover 2, but appropriately stops known per se may be formed as part of the cover or the overall armature 19 to limit its pivotal motion. The electromagnetic drive 13 including the coil 15 and the core 14 are preferably detachably secured to the plastic base 16 by integral plastic pins 31, 32 and 33 projecting upwardly therefrom. The pins 31, 32 and 33 are received in appropriate openings of the flanges (unnumbered) of the bobbin 20 of the coil 15 and the plates 21, 22. In this fashion, the entire electromagnetic drive 13 can be seated in its operative position to the right of the actuator device 5 in the upwardly opening recesses (unnumbered) against the screws 4, but any of the individual components of the electromagnetic drive 13 can be readily disassembled from the plastic base 16 and its pins 31 through 33 by a simply sliding motion therebetween. In this fashion, the stud or element 12 is mechanically innerconnected through the actuator device 5 to the projection 25 of the yoke 24 and, thus, to the overall electromagnetic drive 13, while the same element 12 is further innerconnected through the opposite side of the actuator device 12 to the trippers 9, 10, as is shown in FIG. 3 and as will be more fully described more fully hereinafter relative to FIGS. 5 through 8 of the drawings. However, it is to be noted that the actuator device 5 essentially separates the thermal and magnetic trippers to one side thereof from the electromagnetic drive to the opposite side thereof, yet innerconnects the same therethrough and to the turn-on button 6 and the turn-off button 7.

Reference is now made to FIGS. 5 through 8 of the drawings which illustrates another embodiment of a circuit-breaker of the present invention in which the components shown in FIGS. 1 through 4 have the same reference numerals applied thereto. However, in this instance the armature 19 and its yoke 24 are positioned on the bottom or lower side, as opposed to the upper side, as is readily apparent from a comparision of FIGS. 4 and 5 of the drawings. Thus, in FIG. 5 the yoke 24 is closely adjacent the set of contacts 34 whereas in FIG. 4, the yoke 24 is remote from the same set of contacts (not shown) within the lower housing portion 1.

Figure 5:
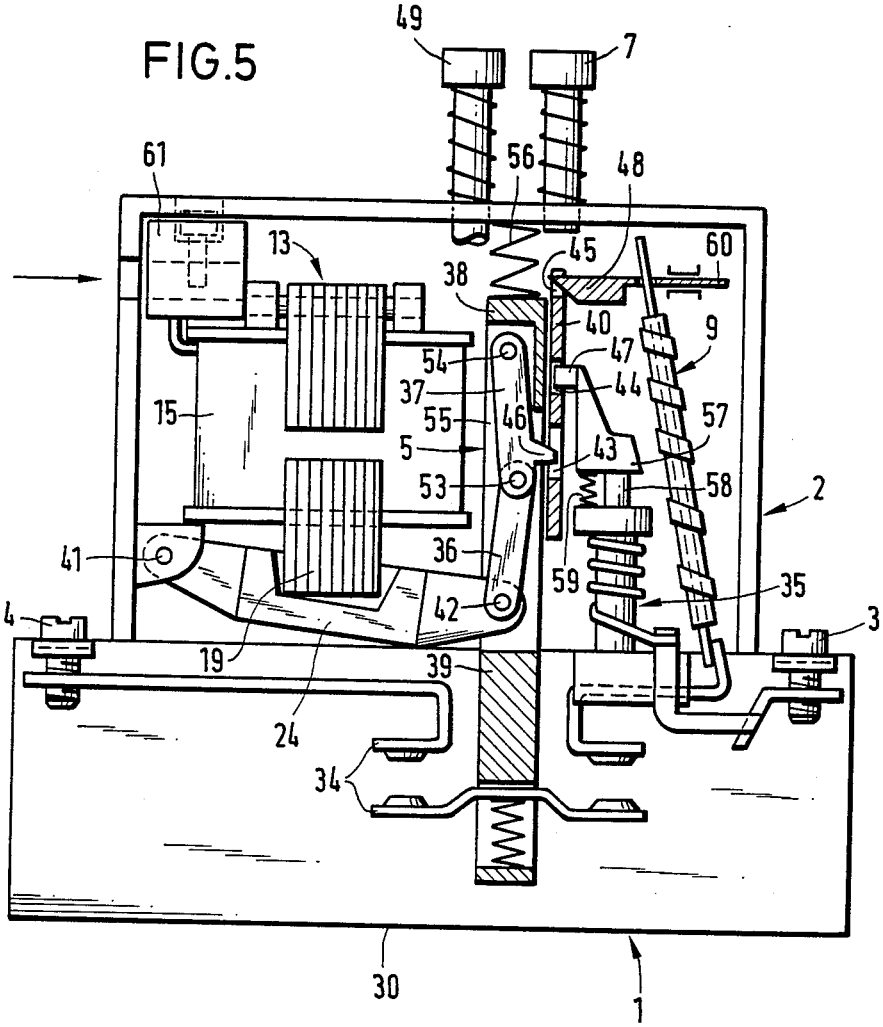
FIG. 5 is a longitudinal cross-sectional view of another circuit-breaker of this invention, and illustrates the components in their turn-off position in which a projection of one of the pair of links and the projections of elements associated with thermal and magnetic trippers are received in slots of a slider associated with an extension of a contact bridge holder carrying the links.
Figure 6:
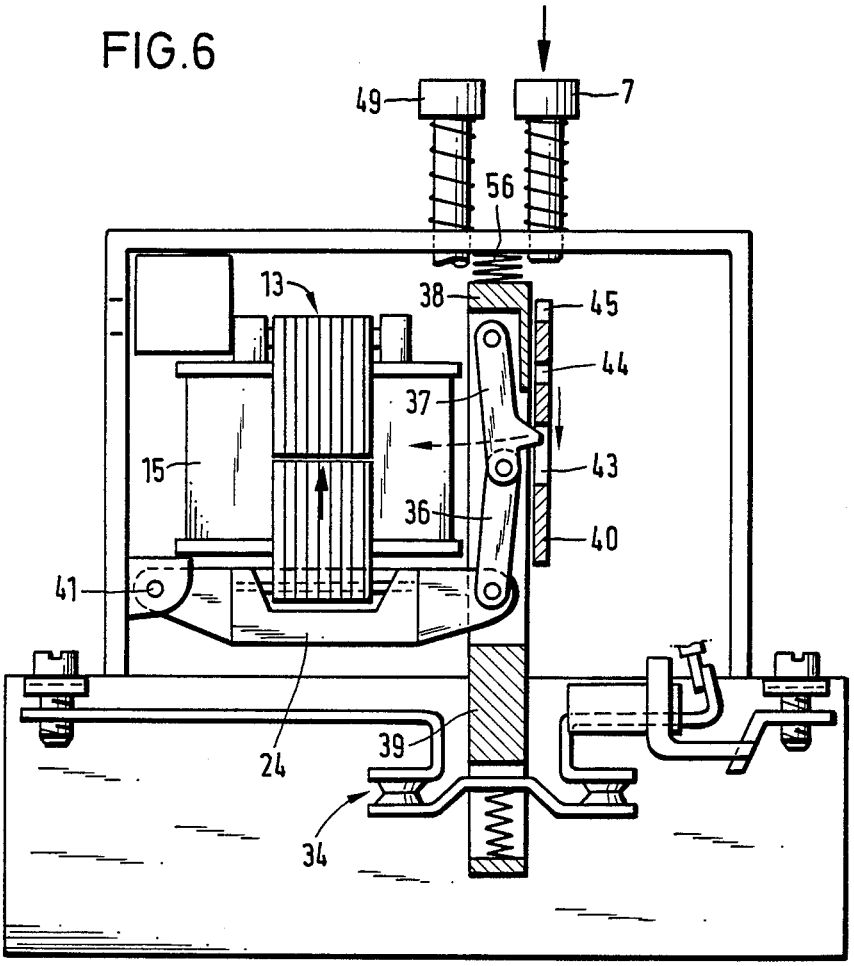
FIG. 6 is a longitudinal sectional view of the circuit-breaker of FIG. 5, and illustrates a turn-off button in its actuated position and the circuit-breaker thus being turned on with associated contacts closed.
Figure 7:
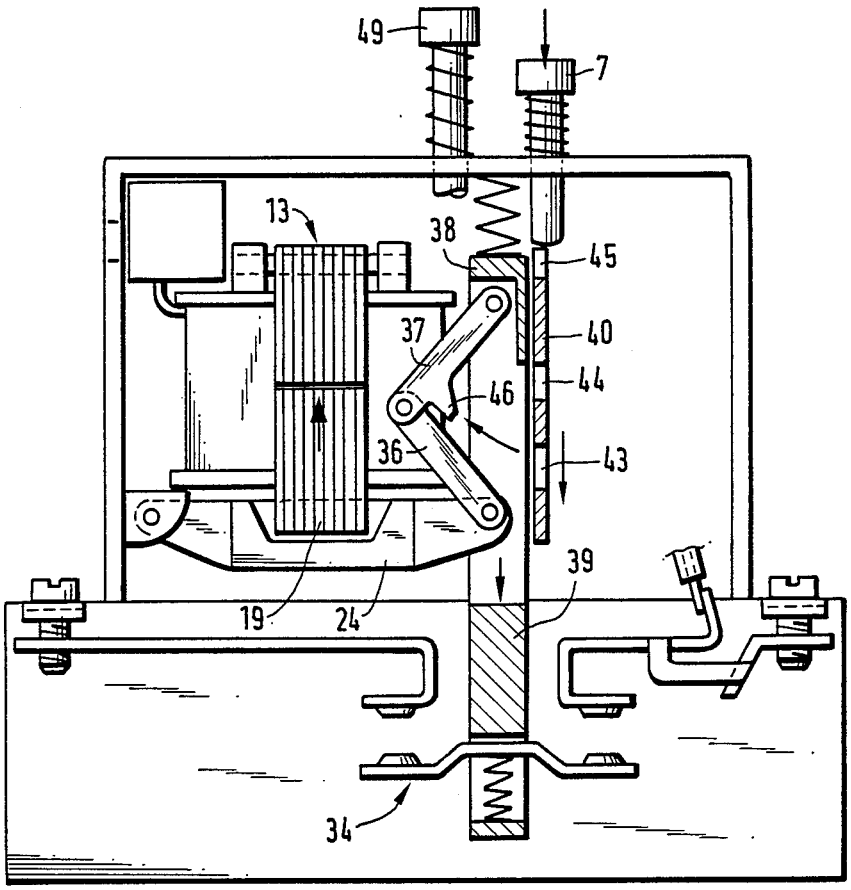
FIG. 7 is a longitudinal sectional view of the circuit-breaker of FIG. 5, and illustrates an intermediate position of the circuit-breaker shortly after having been turned-off.

In the embodiment of the invention shown in FIGS. 5 through 8 the armature 19 is held by the yoke 24, and the latter is in turn pivotally mounted by a pivot bearing or pivot pin 41 at one end thereof to the cover 2 (FIG. 5). An opposite end of the yoke 24, which is the right-hand end thereof in FIG. 5, is connected by a pivot pin 42 to a knuckle joint, linkage or a pair of links 36, 37 which are joined to each other by a pivot pin 53. Appropriately, the two links 36, 37 are mounted next to each other and generally perpendicular to the plane of FIGS. 5 through 8. The links 36, 37 are so arranged relative to each other that they swing out past a vertical dead-center position to both sides thereof, as is shown in FIGS. 6 and 7 of the drawings. A pivot pin 54 pivotally mounts the link 37 to an extension 38 of a common contact-bridge holder 39. The contact-bridge holder 39 holds all of the spring-loaded contact bridges in a conventional manner known per se. In order to save space the links 36, 37 are appropriately housed in recesses 55 in the extension 38. A compression spring 56 is seated on an upper end face (unnumbered) of the extension 38 and rests by its upper end against and inside of the housing cover 2.

A slider 40 is provided at the right-hand side of the extension 38, as best viewed in FIG. 5, and is supported for parallel movement vertically relative to the extension 38 within guide means (not shown). The slider 40 has a slot, recess or clearance 43 which for the OFF or rest position of the circuit-breaker is engaged by a beak or projection 46 of the link 37, as shown in FIG. 5. Also, the projection 46 is provided with a slanted upper and lower face or surface. A slot or recess 44 in the slider 40 receives a beak, nose or projection 47 of a magnetic tripper 35 (FIG. 5). Since three magnetic trippers 35 are required for the three phases, they are mounted next to each other and are perpendicular to the plane of FIG. 5. Thus, the slider 40 also has three recesses to accommodate the three phases and the projections associated herewith. Each beak, projection or nose 47 is integrated into a head 57 connected with a magnetic armature 58 of the magnetic tripper 35. A compression spring 59 is disposed between the head 57 and the bobbin (unnumbered) of the magnetic tripper 35.

Three further recesses or slots 45 are provided at the upper end of the slider 40 and are engaged by studs, noses or projections 48 of the three thermal trippers mounted next to each other and perpendicular to the plane of the drawing. The nose 48 is provided at its lower side, as viewed in FIG. 5, with a chamfer (unnumbered) and is mounted to a plate 60 which is supported for horizontal displacement. Obviously, three such plates or straps 60 are provided, each being engaged by the upper end of a particular associated tripper 9.

A turn-off button 7, just as in FIGS. 1 through 4, is provided in this embodiment so that when it is actuated it controls or moves the upper end of the slider 40. The reset button 49 is also normally spring-biased upwardly by a spring (unnumbered). When the reset button 49 is actuated, the links 36, 37 can be reset from the trip position of FIG. 7 back into the normal rest position of FIG. 5.

The operation of the circuit-breaker of FIGS. 5 through 8 will now be described and reference is first made to FIG. 5 which illustrates the circuit breaker in its REST position, namely, the circuit breaker is turned OFF. The circuit-breaker can be turned ON from a remote operating position through an appropriate coil terminal 61 (FIG. 5) which though illustrated in the upper left-hand of the circuit breaker of this figure can also be located lower as in the area of the connectors 3, 4. The moment the coil 15 is energized through the terminal 61 connected thereto, the circuit-breaker pulls in which means that the armature 19 moves up carrying the yoke 24 upwardly. The yoke 24 thereby lifts the links 36, 37 upwardly which in turn lifts the extension 38 upwardly and carries therewith the contact-bridge holder 39 which closes the set of contacts 34. The slider 40 remains immobile at this time and retains the position shown in FIG. 5.

The now turn-on or ON position is shown in FIG. 6 to which attention is now directed. The circuit-breaker is, of course, both turned ON and OFF by the electromagnetic drive 13, but is also can be turned OFF by depressing the turn-off button 7 which displaces or moves the slider 40 downwardly. As a result of the latter, the upper edge of the slot 43 engages the upper sloped surface or chamfer of the nose 46 of the link 37 so that the links 36, 37 are pivoted from the slightly vertically offset to-the-right position shown in FIG. 5 leftward (See FIG. 6) to and past the dead-center position of the links 37 and finally completely to the left of dead-center, as shown by the links 36, 37 in FIG. 7 which is the OFF position with the contacts 34 open. The compression spring 56 normally biases the extension 38 downwardly and assures rapidly pivoting and displacement of the extension 38 and the contact-bridge holder 39 once the links move past dead-center in the direction of the unnumbered headed arrow associated therewith toward the final position of FIG. 7. The same action occurs under short-circuit conditions. Accordingly, even if the coil 15 were still engaged in the turn-off position of FIG. 7, the circuit-breaker can only be turned on again by pressing the reset button 49 whereby the links 36, 37 are moved back into the initial position shown in FIG. 5 to the vertical dead-center position and toward the right. Due to the force of the compression spring 56, the links 36, 37 are then kept in the slightly rightward past vertical dead-center position. If there is a short in one of the phases, the particular magnetic tripper pulls, whereby the nose 47 thereof moves the slider 40 upwardly. When the slider 40 moves upwardly it impacts by its edge of the associated slot 43 to the associated nose 46 and the links 36, 37 again are pivoted to the left of vertical dead-center position, thereby again creating an impulsive turn-off operation. The same conditions apply to the thermal trippers 9 which upon overload pivot by their upper ends to the left (FIG. 5) so that the chamfer of the nose associated therewith displaces the slider 40 downward and once more the same turn-off process takes place as described above. Thus, the magnetic trippers can be operated both manually and by remote control, not to mention the multiple possible functions of the overall circuit-breaker, particularly the high reliability with respect to "shorts" by increasing the path for the rapid tripping mode due to the links 36, 37. Obviously, because of the simplicity of the circuit-breaker, if there is a malfunction, its source can be rapidly traced. Furthermore, signaling contacts or even pilot lights or the like may be provided in the latter respect to display the existence/-location of defects.

The circuit-breaker may also be equipped with accessory contacts mounted, for example, within the housing or inside a small block on the end face of the housing cover 2. In the latter event a mechanical conection is made with the extension 38 or the contact-bridge holder 39. FIG. 9 shows the latter in a purely schematic manner including an accessory or additional contact 51 in the circuit of the coil 15 of the magnetic drive 13. The accessory contact 51 may be mounted by one of its contact parts, such as a snap leaf-spring 52 which operates in such a manner that when depressed by displacement of the actuator 50, the leaf-spring 52 snaps upwardly into the position shown in phantom outline. Obviously, the actuator 50 can be designed to correspond to the stud 48 of a thermal tripper 9 and be operative by the latter.

Although a preferred embodiment of the invention has been specifically illustrated and described herein, it is to be understood that minor variations may be made in the apparatus without departing from the spirit and scope of the invention, as defined in the amended claims.

We claim:

1. A circuit-breaker comprising a housing having an end, an actuator device positioned upon said end, thermal trippers and magnetic trippers mounted on one side of said actuator device, means for operationally connecting said thermal and magnetic trippers relative to said actuator device, an electromagnetic drive including an armature, said electromagnetic drive being mounted on a second side of said actuator device opposite said one side, a set of contacts adjacent said end, said set of contacts being operable through said thermal and magnetic tripper connecting means, a pair of pivotally connected links, means for connecting said pair of links between said armature and said thermal and magnetic tripper connecting means, a slider mounted adjacent and movable relative to said thermal and magnetic tripper connecting means, means for selectively engaging and disengaging said links relative to said slider, and means for connecting said thermal and magnetic trippers to said slider.

2. The circuit-breaker as defined in claim 1 wherein said thermal and magnetic tripper connecting means is an extension of a contact-bridge holder of said set of contacts.

3. The circuit-breaker as defined in claim 1 wherein said armature includes a pivotal yoke movable by a coil of said armature, and said yoke is pivotally connected to one of said pair of links.

4. The circuit-breaker as defined in claim 1 wherein said link selection engaging means includes a projection carried by one of said links and a recess in said slider for receiving said projection.

5. The circuit-breaker as defined in claim 1 wherein said thermal and magnetic tripper connecting means includes a projection associated with each and a recess in said slider for receiving each said thermal and magnetic tripper projections.

6. The circuit-breaker as defined in claim 1 wherein said link selection engaging means includes a projection carried by one of said links and a recess in said slider for receiving said projection, and wherein said thermal and magnetic tripper connecting means includes a projection associated with each and a recess in said slider for receiving each said thermal and magnetic tripper projections.

7. The circuit-breaker as defined in claim 1 wherein said armature operates a turn-on button carried by said actuator device, and means mounting said turn-off button for relatively moving said slider.

8. The circuit-breaker as defined in claim 1 including a reset button carried by said actuator device, and means mounting said reset button to move said pair of links from a first past dead-center position through dead-center to a second past dead-center position.

9. The circuit-breaker as defined in claim 1 wherein said armature is part of said electomagnetic drive which includes a coil, an auxiliary contact in a circuit of said coil, and means operative in response to said thermal trippers for actuating said auxiliary contact.

10. The circuit-breaker as defined in claim 1 wherein said armature is part of an electromagnetic drive having a coil, an auxiliary contact in a circuit of said coil, said auxiliary contact including a snap leaf spring, and means operative in response to said thermal trippers for actuating said snap leaf spring to thereby actuate said auxiliary contact.

11. The circuit-breaker as defined in claim 1 wherein said armature operates a turn-on button carried by said actuator device, said turn-on button includes a lateral stud, said armature includes a projection, and said lateral stud supports said armature projection.

12. The circuit-breaker as defined in claim 1 including means for pivotally supporting said armature.

13. The circuit-breaker as defined in claim 1 wherein said armature and a core of said electromagnetic drive form three legs, a coil of said armature being mounted upon a center leg of said three legs, a generally U-shaped yoke enclosing said armature, means mounting said yoke for pivotal movement at one end of said yoke, and an opposite end of said yoke being effective to operate said element.

14. The circuit-breaker as defined in claim 1 wherein said housing carries a plurality of integral pins and said electromagnetic drive has openings slidably receiving said pins for readily mounting said electromagnetic drive upon and removing said electromagnetic drive from said housing.

15. The circuit-breaker as defined in claim 4 including a reset button carried by said actuator device, and means mounting said reset button to first move said pair of links from a first past dead-center position through dead-center to a second past dead-center position.

16. The circuit-breaker as defined in claim 4 wherein said armature operates a turn-on button carried by said actuator device, said turn-on button includes a lateral stud, said armature includes a projection, and said lateral stud supports said armature projection.

17. The circuit-breaker as defined in claim 4 wherein said armature and a core of said electromagnetic drive form three legs, a coil of said armature being mounted upon a center leg of said three legs, a generally U-shaped yoke enclosing said armature, means mounting said yoke for pivotal movement at one end of said yoke, and an opposite end of said yoke being effective to operate said element.

18. The circuit-breaker as defined in claim 5 including a reset button carried by said actuator device, and means mounting said reset button to first move said pair of links from a first past dead-center position through dead-center to a second past dead-center position.

19. The circuit-breaker as defined in claim 5 wherein said armature operates a turn-on button carried by said actuator device, said turn-on button includes a lateral stud, said armature includes a projection, and said lateral stud supports said armature projection.

* * * * *